US009786220B2

(12) United States Patent
Won et al.

(10) Patent No.: US 9,786,220 B2
(45) Date of Patent: Oct. 10, 2017

(54) DISPLAY DEVICE AND METHOD OF DRIVING DISPLAY DEVICE

(71) Applicant: Samsung Display Co., Ltd., Yongin, Gyeonggi-do (KR)

(72) Inventors: Byeong-Hee Won, Hwaseong-si (KR); Il-Nam Kim, Hwaseong-si (KR); Jong-In Baek, Suwon-si (KR); Min-Gyeong Jo, Busan (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 125 days.

(21) Appl. No.: 14/574,161

(22) Filed: Dec. 17, 2014

(65) Prior Publication Data

US 2015/0364091 A1 Dec. 17, 2015

(30) Foreign Application Priority Data

Jun. 13, 2014 (KR) ..... 10-2014-0072334

(51) Int. Cl.
*G09G 3/32* (2016.01)
*G09G 3/3233* (2016.01)

(52) U.S. Cl.
CPC ... *G09G 3/3233* (2013.01); *G09G 2300/0852* (2013.01); *G09G 2310/0251* (2013.01); *G09G 2310/0262* (2013.01)

(58) Field of Classification Search
CPC ... G09G 2300/0814; G09G 2300/0819; G09G 2300/0852; G09G 2300/0861; G09G 2310/0251; G09G 2310/0262; G09G 2320/0242
See application file for complete search history.

(56) References Cited

U.S. PATENT DOCUMENTS 7,545,351 B2 * 6/2009 Shin ..... G09G 3/325 345/76
8,344,975 B2 * 1/2013 Shirouzu ..... G09G 3/3233 345/82
2005/0156829 A1 * 7/2005 Choi ..... G09G 3/3233 345/76
2007/0268234 A1 11/2007 Wakabayashi et al.
2009/0244110 A1 * 10/2009 Ogura ..... G09G 3/3233 345/690

(Continued)

FOREIGN PATENT DOCUMENTS

KR 10-2011-0118646 A 10/2011
KR 10-2012-0052754 A 5/2012
KR 10-2015-0125149 A 11/2015

*Primary Examiner* — Bryan Earles
(74) *Attorney, Agent, or Firm* — Ladas & Parry LLP

(57) ABSTRACT

A display device and method of driving the display device are disclosed. In one aspect, the display device includes a display panel including a plurality of pixels and a scan driver configured to apply a scan signal having activation and deactivation levels to the pixels. Each of the pixels includes a storage capacitor, a switching transistor, a driving transistor and an emitting element configured to emit light based on an emission current received from the driving transistor. The scan driver is configured to selectively control the activation level of the scan signal so as to control the amount of charge stored in the storage capacitor. The driving transistor is configured to control the emission current based on the amount of charge stored in the storage capacitor.

20 Claims, 3 Drawing Sheets

(56) References Cited

U.S. PATENT DOCUMENTS

| | | | | |
|---|---|---|---|---|
| 2010/0179469 | A1 | 7/2010 | Hammond et al. | |
| 2010/0328278 | A1* | 12/2010 | Ishiguro | G09G 3/3233 345/205 |
| 2011/0279049 | A1* | 11/2011 | Kawabe | G09G 3/3233 315/228 |
| 2012/0001896 | A1* | 1/2012 | Han | G09G 3/3233 345/214 |
| 2013/0306969 | A1* | 11/2013 | Park | H01L 29/41733 257/57 |
| 2014/0152719 | A1* | 6/2014 | Jung | G09G 3/3233 345/691 |
| 2015/0051672 | A1 | 2/2015 | Jo et al. | |
| 2015/0371589 | A1* | 12/2015 | Kim | G09G 3/3258 345/208 |

* cited by examiner

DISPLAY DEVICE AND METHOD OF DRIVING DISPLAY DEVICE

CROSS-REFERENCE TO RELATED APPLICATION

This application claims priority under 35 USC §119 to Korean Patent Application No. 10-2014-0072334, filed on Jun. 13, 2014 in the Korean Intellectual Property Office (KIPO), the contents of which are herein incorporated by reference in their entirety.

BACKGROUND

Field

The described technology generally relates to display devices and methods of driving the display devices.

Description of the Related Technology

The gamma settings of a display device encode the correlation between the luminance of the display to grayscale data. According to Weber's law, human eyes are more sensitive to relatively bright colors and less sensitive to relatively dark colors. Thus, the correlations of the gamma settings can be nonlinearly determined based on our physiological characteristics. In addition, to ensure that viewers perceive even changes in the luminance of the display, the gamma correction can be performed by changing the predetermined correlations of the luminance to the grayscale data for the display.

In order to perform gamma correction, a target luminance and target color coordinates for white color is determined. When gamma correction operation is performed, output luminance and output color coordinates of the white color may be substantially the same as the target luminance and the target color coordinates of the white color.

In addition, after the gamma correction operation, the maximum luminance of each primary color can be determined and the display device cannot output light with a luminance higher than these maximum luminances.

SUMMARY OF CERTAIN INVENTIVE ASPECTS

One inventive aspect is a display device that can output light with a higher luminance than the maximum luminance determined by performing gamma setting.

Another aspect is a method of driving a display device capable of outputting light with a luminance higher than the maximum luminance determined by performing gamma setting.

Another aspect is a display device including a display panel, a scan driver and a data driver. The display panel includes a pixel. The scan driver applies a scan signal to the pixel. The data driver applies a data signal to the pixel. The pixel includes a storage capacitor, a data applying transistor, a driving transistor and an emitting element. The storage capacitor stores electric charge based on the data signal. The data applying transistor applies the data signal to the storage capacitor in response to the scan signal. The driving transistor generates an emission current corresponding to an amount of charge stored in the storage capacitor. The emitting element emits light based on the emission current. The scan driver controls an activation level of the scan signal. The amount of charge stored in the storage capacitor is controlled based on the activation level of the scan signal and the emission current is controlled based on the amount of charge stored in the storage capacitor.

In an example embodiment, the activation level of the scan signal may be controlled by decreasing the difference between the activation level and a deactivation level of the scan signal and the emission current may increase based on the controlled activation level of the scan signal.

In an example embodiment, the activation level of the scan signal may be controlled when an operating mode of the display device is changed.

In an example embodiment, the activation level of the scan signal may be controlled when the operating mode of the display device is changed from a normal mode to a photo therapy mode and the emission current may increase based on the controlled activation level of the scan signal.

In an example embodiment, the emitting element may be an organic light-emitting diode (OLED).

In an example embodiment, the pixel may further include an initialization transistor, a first emission control transistor, a diode connecting transistor and a second emission control transistor. The initialization transistor may apply an initialization voltage to the storage capacitor in response to an initialization signal. The first emission control transistor may connect a first power supply voltage with a first electrode of the driving transistor in response to an emission signal. The diode connecting transistor may connect a gate electrode of the driving transistor with a second electrode of the driving transistor in response to the scan signal. The second emission control transistor may connect the second electrode of the driving transistor with the emitting element in response to the emission signal.

In an example embodiment, the storage capacitor may be initialized based on the initialization voltage applied by the initialization transistor.

In an example embodiment, the data signal may be applied to the storage capacitor through the data applying transistor, the driving transistor and the diode connecting transistor while the scan signal is activated after the storage capacitor is initialized.

In an example embodiment, the activation level of the scan signal may be controlled by decreasing a difference between the activation level and a deactivation level of the scan signal and a first current may decrease based on the controlled activation level of the scan signal. The first current may correspond to the data signal and flowing through the data applying transistor, the driving transistor and the diode connecting transistor.

In an example embodiment, the pixel may further include a boost capacitor. The boost capacitor may be connected between a gate electrode of the driving transistor and a gate electrode of the data applying transistor and may boost a level of the data signal applied to the storage capacitor when the scan signal is deactivated.

In an example embodiment, the activation level of the scan signal may be controlled by decreasing a difference between the activation level and a deactivation level of the scan signal, and the level of the data signal boosted by the boost capacitor may decrease.

According to example embodiments, a display device includes a display panel, a scan driver and a data driver. The display panel includes a pixel. The scan driver applies a scan signal to the pixel. The data driver applies a data signal to the pixel. The pixel includes a storage capacitor, a data applying transistor, a driving transistor and an emitting element. The storage capacitor stores electric charge based on the data signal. The data applying transistor applies the data signal to the storage capacitor in response to the scan signal. The driving transistor generates an emission current corresponding to an amount of charge stored in the storage capacitor.

The emitting element emits light based on the emission current. The scan driver controls an activation level of the scan signal when an operating mode of the display device is changed. The amount of charge stored in the storage capacitor is controlled based on the activation level of the scan signal and the emission current is controlled based on the amount of charge stored in the storage capacitor.

In an example embodiment, the activation level of the scan signal may be controlled by decreasing a difference between the activation level and a deactivation level of the scan signal and the emission current may increase based on the controlled activation level of the scan signal.

In an example embodiment, the scan driver may control the activation level of the scan signal when the operating mode of the display device is changed from a normal mode to a photo therapy mode or when the operating mode of the display device is changed from the photo therapy mode to the normal mode.

In an example embodiment, the activation level of the scan signal may be controlled when the operating mode of the display device is changed from the normal mode to the photo therapy mode and the emission current may increase based on the controlled activation level of the scan signal.

According to example embodiments, in a method of driving a display device including a pixel, the pixel includes a storage capacitor, a data applying transistor, a driving transistor and an emitting element. An activation level of a scan signal applied to the data applying transistor is controlled. An amount of charge stored in the storage capacitor is controlled based on the activation level of the scan signal. An emission current corresponding to the amount of charge stored in the storage capacitor is generated by the driving transistor. Light with luminance corresponding to the emission current is output by the emitting element.

In an example embodiment, the activation level of the scan signal may be controlled by decreasing a difference between the activation level and a deactivation level of the scan signal, and the emission current may increase based on the controlled activation level of the scan signal.

In an example embodiment, the activation level of the scan signal may be controlled when an operating mode of the display device is changed.

In an example embodiment, the activation level of the scan signal may be controlled when the operating mode of the display device is changed from a normal mode to a photo therapy mode and the emission current may increase based on the controlled activation level of the scan signal.

In an example embodiment, the activation level of the scan signal may be controlled when the operating mode of the display device is changed from the photo therapy mode to the normal mode and the emission current may decrease based on the controlled activation level of the scan signal.

Another aspect is a display device comprising a display panel including a plurality of pixels; a scan driver configured to apply a scan signal to the pixels, wherein the scan signal has an activation level and a deactivation level; and a data driver configured to apply a data signal to the pixels, wherein each of the pixels comprises: a storage capacitor configured to store charge based on the data signal; a switching transistor configured to apply the data signal to the storage capacitor in response to the scan signal; a driving transistor configured to generate an emission current corresponding to the stored charge; and an emitting element configured to emit light based on the emission current, wherein the scan driver is configured to selectively control the activation level of the scan signal, wherein the scan driver is further configured to select the activation level of the scan signal so as to control the amount of charge stored in the storage capacitor, and wherein the driving transistor is configured to control the emission current based on the amount of charge stored in the storage capacitor.

In example embodiments, the scan driver is further configured to decrease the difference between the activation level and the deactivation level of the scan signal and the driving transistor is further configured to increase the emission current based on the decrease in the difference between the activation and deactivation levels of the scan signal. The scan driver can be further configured to select the activation level of the scan signal when an operating mode of the display device is changed. The scan driver can be further configured to select the activation level of the scan signal when the operating mode of the display device is changed from a normal mode to a photo therapy mode and the emission current can be configured to increase based on the selected activation level of the scan signal. The emitting element can be an organic light-emitting diode (OLED).

In example embodiments, each of the pixels further includes an initialization transistor configured to apply an initialization voltage to the storage capacitor in response to an initialization signal; a first emission control transistor configured to connect a first power supply voltage to a first electrode of the driving transistor in response to an emission signal; a diode connecting transistor configured to connect a gate electrode of the driving transistor to a second electrode of the driving transistor in response to the scan signal; and a second emission control transistor configured to connect the second electrode of the driving transistor to the OLED in response to the emission signal. The initialization transistor can be further configured to apply the initialization voltage to the storage capacitor so as to initialize the storage capacitor. The storage capacitor can be configured to receive the data signal via the switching transistor, the driving transistor and the diode connecting transistor when the scan signal is activated after the storage capacitor is initialized. The storage capacitor can be configured to receive the data signal as a data current via the switching transistor, the driving transistor and the diode connecting transistor, the scan driver can be further configured to selectively decrease the difference between the activation level and the deactivation level of the scan signal and the data current can be configured to decrease based on the decrease in the difference between the activation and deactivation levels of the scan signal.

In example embodiments, each of the pixels further includes a boost capacitor connected between a gate electrode of the driving transistor and a gate electrode of the switching transistor, wherein the boost transistor is configured to boost a level of the data signal applied to the storage capacitor when the scan signal is deactivated. The scan driver can be further configured to selectively decrease the difference between the activation level and the deactivation level of the scan signal and the level of the data signal boosted by the boost capacitor can be configured to decrease based on the decrease in the difference between the activation and deactivation levels of the scan signal.

Another aspect is a display device comprising a display panel including a plurality of pixels; a scan driver configured to apply a scan signal to the pixels, wherein the scan signal has an activation level and a deactivation level; and a data driver configured to apply a data signal to the pixels, wherein each of the pixels comprises: a storage capacitor configured to store charge based on the data signal; a switching transistor configured to apply the data signal to the storage capacitor in response to the scan signal; a driving transistor configured to generate an emission current corresponding to the stored charge; and an emitting element configured to emit light based on the emission current, wherein the scan driver is configured to selectively control the activation level of the scan signal when an operating mode of the display device is changed, wherein the scan driver is further configured to select the activation level of the scan signal so as to control the amount of charge stored in the storage capacitor, and wherein the driving transistor is configured to control the emission current based on the amount of charge stored in the storage capacitor.

In example embodiments, the scan driver is further configured to decrease the difference between the activation level and the deactivation level of the scan signal and the driving transistor is further configured to increase the emission current based on the decrease in the different between the activation and deactivation levels of the scan signal. The scan driver can be further configured to selectively control the activation level of the scan signal when the operating mode of the display device is changed from a normal mode to a photo therapy mode and the operating mode of the display device can be changed from the photo therapy mode to the normal mode. When the operating mode of the display device is changed from the normal mode to the photo therapy mode, the driving transistor can be further configured to increase the emission current based on the controlled activation level of the scan signal.

Another aspect is a method of driving a display device including a plurality of pixels, each of the pixels including a storage capacitor, a switching transistor, a driving transistor and an emitting element, the method comprising controlling an activation level of a scan signal applied to the data applying transistor; controlling an amount of charge stored in the storage capacitor based on the activation level of the scan signal; generating, by the driving transistor, an emission current corresponding to the amount of charge stored in the storage capacitor; and emitting, by the emitting element, light with a luminance corresponding to the emission current.

In example embodiments, the scan signal has the activation level and a deactivation level, the activation level of the scan signal is controlled by decreasing the difference between the activation level and the deactivation level of the scan signal and driving transistor increases the emission current based on the decrease in the difference between the activation and deactivation levels of the scan signal. The activation level of the scan signal can be controlled when an operating mode of the display device is changed. The activation level of the scan signal can be controlled when the operating mode of the display device is changed from a normal mode to a photo therapy mode and the driving transistor can increase the emission current based on the controlled activation level of the scan signal. The activation level of the scan signal can be controlled when the operating mode of the display device is changed from the photo therapy mode to the normal mode and the driving transistor can decrease the emission current based on the controlled activation level of the scan signal.

Accordingly, in the display device and the method of driving the display device according to at least one embodiment, the amount of charge stored in the storage capacitor can be controlled based on the activation level of the scan signal, and thus the display device can emit light with a luminance higher than the maximum luminance determined by the gamma settings by controlling the activation level of the scan signal.

DETAILED DESCRIPTION OF CERTAIN INVENTIVE EMBODIMENTS

Figure 1:
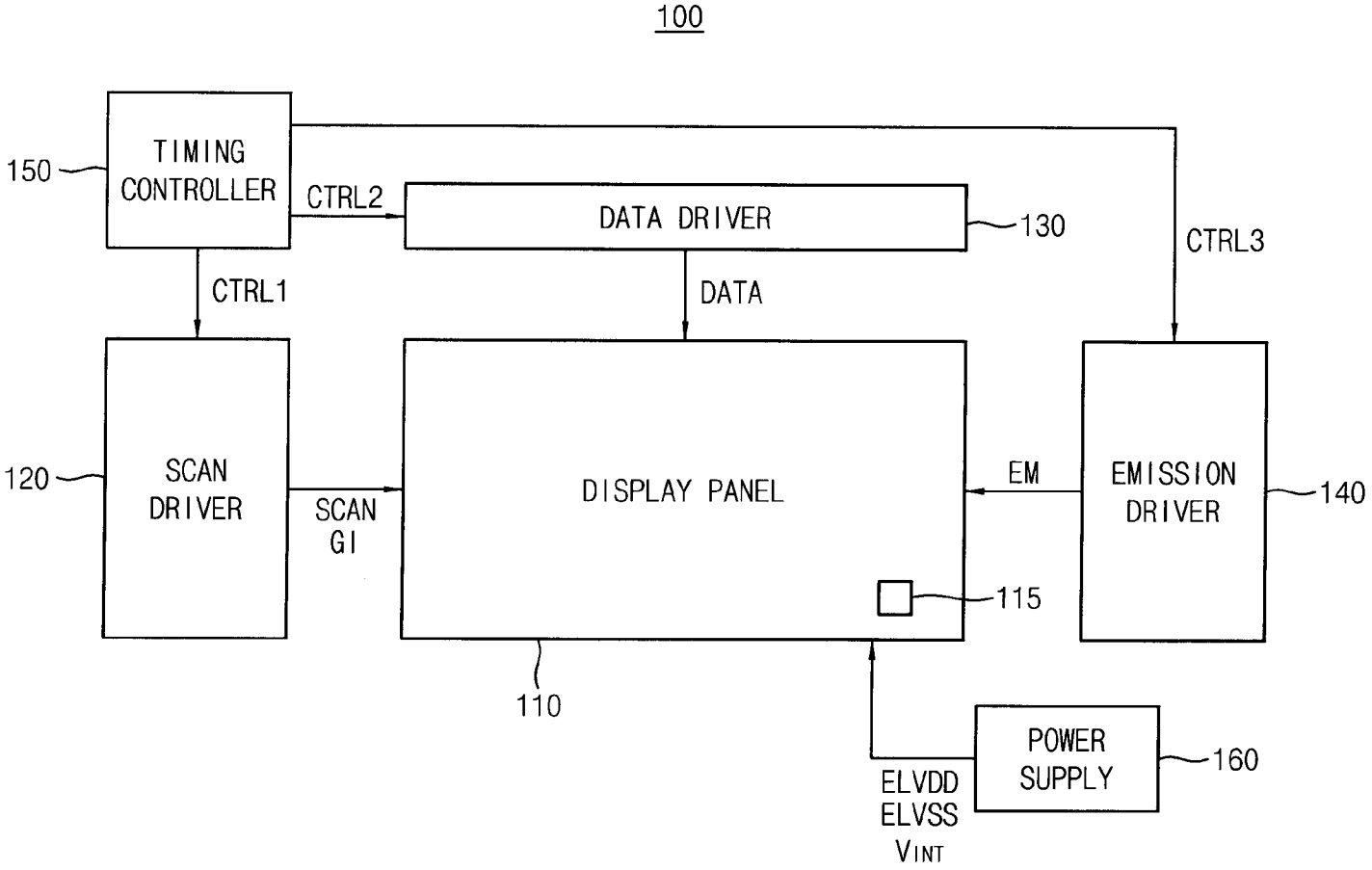
FIG. 1 is a block diagram illustrating a display device according to example embodiments.

Hereinafter, embodiments of the described technology will be explained in detail with reference to the accompanying drawings. Like or similar reference numerals refer to like or similar elements throughout.

FIG. 1 is a block diagram illustrating a display device according to example embodiments.

Referring to FIG. 1, the display device 100 includes a display panel 110, a scan driver 120, a data driver 130, an emission driver 140 and a timing controller 150. The display device 100 may further include a power supply 160.

The display panel 110 includes a pixel 115. The pixel 115 includes a storage capacitor, a data applying transistor or switching transistor, a driving transistor and an emitting element. The storage capacitor is charged (e.g., stores electric charge) based on a data signal DATA. The data applying transistor applies the data signal DATA to the storage capacitor in response to a scan signal SCAN. The driving transistor generates an emission current corresponding to the amount of charge stored in the storage capacitor. The emitting element outputs light based on the emission current.

Although FIG. 1 illustrates the display panel 110 as including one pixel 115, according to example embodiments, the display panel may include a plurality of pixels each of which has a configuration substantially the same as that of the pixel 115.

When the amount of charge stored in the storage capacitor changes, the voltage difference between two electrodes of the storage capacitor also changes, and the voltage level at a gate electrode of the driving transistor changes correspondingly since the storage capacitor is connected to the gate electrode of the driving transistor. Thus, the emission current generated by the driving transistor also changes.

In some example embodiments, the activation level of the scan signal SCAN is controlled by decreasing the difference between the activation level and the deactivation level of the scan signal, Accordingly, the emission current increases based on the selected activation level of the scan signal SCAN. In other example embodiments, the activation level of the scan signal SCAN is controlled by increasing the difference between the activation level and the deactivation level of the scan signal, and thus the emission current decreases based on the selected activation level of the scan signal SCAN. The activation level of the scan signal SCAN refers to the voltage level of the scan signal SCAN when the scan signal SCAN is activated and the deactivation level of the scan signal SCAN refers to the voltage level of the scan signal SCAN when the scan signal SCAN is deactivated. Detailed configurations and operations of the pixel 115 will be described with reference FIGS. 2 through 4.

The scan driver 120 applies the scan signal SCAN to the pixel 115 and controls the activation level of the scan signal SCAN. The scan driver 120 further applies an initialization signal GI to the pixel 115. The data driver 130 applies the data signal DATA to the pixel 115 when the scan signal SCAN is activated. The gate electrode of the driving transistor included in the pixel 115 is initialized based on an initialization voltage $V_{INT}$ when the initialization signal GI is activated.

In some example embodiments, as described above, the display panel 110 includes a plurality of pixels that are arranged in a matrix of rows and columns. The initialization signal GI is applied pixels connected to a n-th row, where n is a natural number equal to or greater than two, and has a timing corresponding to the scan signal SCAN applied to a pixel connected to a (n−1)-th row. When the scan signal SCAN applied to the (n−1)-th row is activated, the data signal DATA is applied to the pixel connected to the (n−1)-th row and a gate electrode of a driving transistor included in the pixel connected to the n-th row is substantially simultaneously initialized.

The emission driver 140 applies an emission signal EM to the pixel 115. The pixel 115 emits light when the emission signal EM is activated. The timing controller 150 controls the operations of the scan driver 120 (e.g., the activation of the scan signal SCAN) based on a first control signal CTRL1, controls the operations of the data driver 130 (e.g., the generation of the data signal DATA and application of the data signal DATA to the pixel 115) based on a second control signal CTRL2 and controls the operations of the emission driver 140 (e.g., the activation of the emission signal EM) based on a third control signal CTRL3. The power supply 160 applies a first power supply voltage ELVDD and a second power supply voltage ELVSS to the pixel 115. The power supply 160 further applies the initialization voltage $V_{INT}$ to the pixel 115.

In some example embodiments, the scan driver 120 controls the activation level of the scan signal SCAN when the operating mode of the display device 100 is changed. For example, the activation level of the scan signal SCAN is controlled when the operating mode of the display device 100 is changed from a normal mode to a photo therapy mode, and thus the emission current can increase based on the controlled activation level of the scan signal SCAN. In another example, the activation level of the scan signal SCAN is controlled when the operating mode of the display device is changed from the photo therapy mode to the normal mode, and thus the emission current is restored (e.g., decreases) based on the controlled activation level of the scan signal SCAN. In the photo therapy mode, the display device 100 can emit light with a single color. In addition, in the photo therapy mode, it is required to output light from the display device 100 with a relatively high luminance. The activation level of the scan signal SCAN is therefore controlled when the display device 100 operates in the photo therapy mode, and thus the display device 100 emits light with a higher luminance than the maximum luminance determined by a gamma setting operation (i.e., the gamma settings of the display device 100), during the photo therapy mode.

Figure 2:
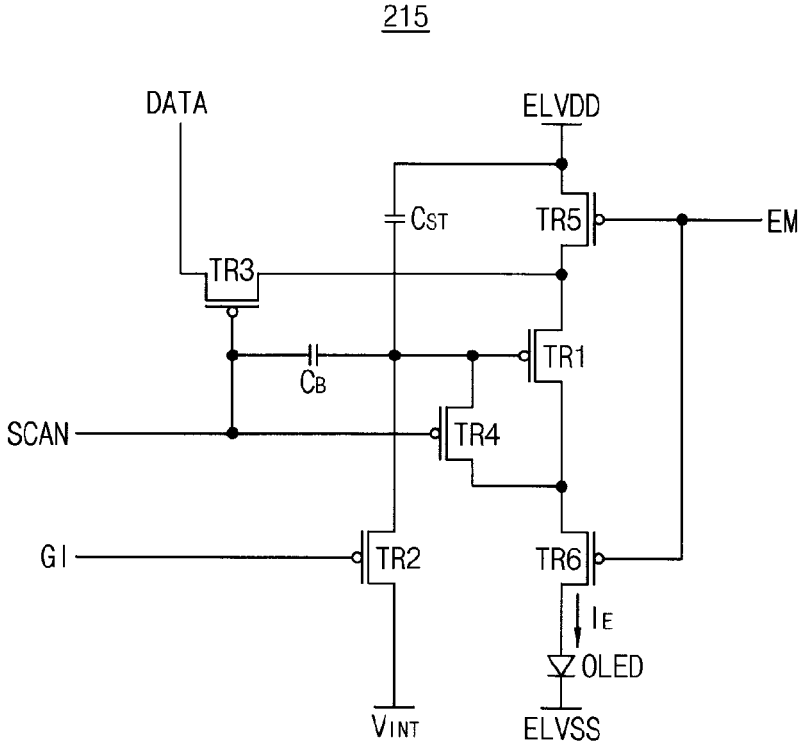
FIG. 2 is a circuit diagram illustrating an example of a pixel included in the display device of FIG. 1.
Figure 3:
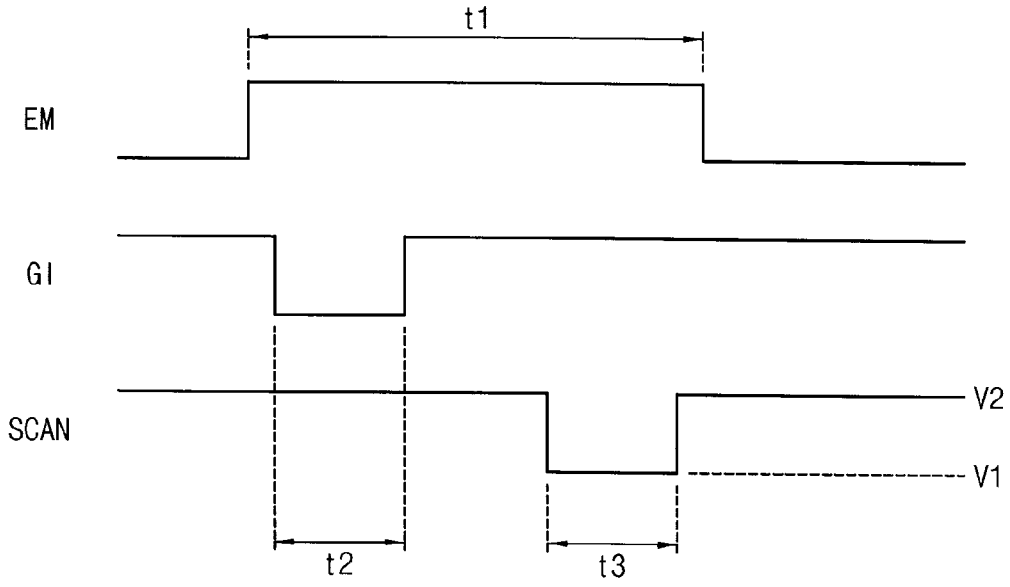
FIG. 3 is a timing diagram illustrating an emission signal, an initialization signal and a scan signal applied to the pixel of FIG. 2 according to example embodiments.

FIG. 2 is a circuit diagram illustrating an example of a pixel included in the display device of FIG. 1. FIG. 3 is a timing diagram illustrating an emission signal, an initialization signal and a scan signal applied to the pixel of FIG. 2.

Referring to FIGS. 2 and 3, the pixel 215 includes a storage capacitor $C_{ST}$, a data applying transistor or switching transistor TR3, a driving transistor TR1 and an emitting element OLED. The pixel 215 further includes an initialization transistor TR2, a first emission control transistor TR5, a diode connecting transistor TR4 and a second emission control transistor TR6. The pixel 215 further includes a boost capacitor $C_B$.

In some example embodiments, in one horizontal period, the initialization signal GI and the scan signal SCAN are activated while the emission signal EM is deactivated (e.g., during a period t1). First, the initialization signal GI is activated and then the scan signal SCAN is activated after the initialization signal GI is deactivated. In other words, while the emission signal EM is deactivated (e.g., during the period t1), the initialization signal GI has an activation period t2 and subsequently the scan signal SCAN has an activation period t3 after the initialization signal GI is deactivated.

In some example embodiments, the emitting element OLED is an organic light-emitting diode (OLED) that emits light based on an emission current IE. The OLED emits light with a luminance corresponding to the emission current IE. The OLED has a first electrode connected to the second power supply voltage ELVSS and a second electrode connected to a second electrode of the second emission control transistor TR6. Although not illustrated in FIG. 2, the pixel 215 may further include a parasitic capacitor connected in parallel to the OLED. After the second electrode of the OLED is initialized, a leakage current is induced through the driving transistor TR1 via the parasitic capacitor when the data signal DATA corresponding to zero luminance (e.g., black) is applied to a gate electrode of the driving transistor TR1.

The initialization transistor TR2 applies the initialization voltage $V_{INT}$ to the storage capacitor $C_{ST}$ in response to the initialization signal GI. The initialization transistor TR2 has a first electrode receiving the initialization voltage $V_{INT}$, a gate electrode receiving the initialization signal GI and a second electrode connected to the gate electrode of the driving transistor TR1. In some example embodiments, the storage capacitor $C_{ST}$ is initialized based on the initialization voltage $V_{INT}$ applied by the initialization transistor TR2 in each frame and the amount of charge stored in the storage capacitor $C_{ST}$ is initialized based on the initialization voltage $V_{INT}$ in each frame. In other words, the voltage difference between two electrodes of the storage capacitor $C_{ST}$ can be initialized to a first voltage in each frame. In these embodiments, the first voltage corresponds to a voltage (e.g., ELVDD-$V_{INT}$) obtained by subtracting the initialization voltage $V_{INT}$ from the first power supply voltage ELVDD. The level of the initialization voltage $V_{INT}$ can be set to a level sufficiently less than the normal level of the data signal DATA.

The data applying transistor TR3 applies the data signal DATA to the storage capacitor $C_{ST}$ in response to the scan signal SCAN. The data applying transistor TR3 has a first electrode receiving the data signal DATA, a gate electrode receiving the scan signal SCAN and a second electrode connected to a first electrode of the driving transistor TR1.

The diode connecting transistor TR4 connects the gate electrode of the driving transistor TR1 with a second electrode of the driving transistor TR1 in response to the scan signal SCAN. The driving transistor TR1 operates as a diode when the gate electrode of the driving transistor TR1 is connected to the second electrode of the driving transistor TR1 due to the diode connecting transistor TR4. The diode connecting transistor TR4 has a first electrode connected to the second electrode of the driving transistor TR1, a gate electrode receiving the scan signal SCAN and a second electrode connected to the gate electrode of the driving transistor TR1.

In some example embodiments, the data applying transistor TR3 and the diode connecting transistor TR4 both operate in their respective saturation regions.

The storage capacitor $C_{ST}$ is charged (e.g., stores the electric charge) based on the data signal DATA applied by the data applying transistor TR3. The storage capacitor $C_{ST}$ is connected between the first power supply voltage ELVDD and the gate electrode of the driving transistor TR1. The voltage level at the gate electrode of the driving transistor TR1 is maintained during a predetermined period based on the charge stored in the storage capacitor $C_{ST}$.

In some example embodiments, the data signal DATA is applied to the storage capacitor $C_{ST}$ through the data applying transistor TR3, the driving transistor TR1 and the diode connecting transistor TR4 while the scan signal SCAN is activated after the storage capacitor $C_{ST}$ is initialized. When the scan signal SCAN is activated, the data applying transistor TR3 applies the data signal DATA to the driving transistor TR1, the driving transistor TR1 operates as a diode due to the diode connecting transistor TR4, and thus the data signal DATA compensated by a threshold voltage is applied to the gate electrode of the driving transistor TR1.

The data applying transistor TR3 has a gate electrode receiving the scan signal SCAN. The amount of charge stored in the storage capacitor $C_{ST}$ while the scan signal SCAN is activated can be controlled based on the activation level V1 of the scan signal SCAN.

Typically, a transistor, which has a source electrode, a gate electrode and a drain electrode and operates in a linear region, can operate as a variable resistor such that the resistance between the source and drain electrodes of the transistor is selected based on the voltage level at the gate electrode of the transistor. For example, in a p-type metal oxide semiconductor (PMOS) transistor operating in a linear region, the resistance between the source electrode and the drain electrode decreases as the voltage level at the gate electrode is decreased to less than the voltage level at the source electrode. Accordingly, if the voltage level at the gate electrode is sufficiently low, the resistance between the source and drain electrodes is substantially zero, and thus the PMOS transistor operates as a switch that connects the source electrode to the drain electrode. In addition, in the PMOS transistor operating in the linear region, the resistance between the source and drain electrodes increases as the voltage level at the gate electrode approaches the voltage level at the source electrode. Accordingly, if the voltage level at the gate electrode is sufficiently close to the voltage level at the source electrode, the resistance between the source and drain electrodes is substantially infinite, and thus the PMOS transistor can operate as a switch that disconnects the source electrode from the drain electrode. However, when the voltage level at the gate electrode is not sufficiently low and the voltage level at the gate electrode is not sufficiently close to the voltage level at the source electrode, the PMOS transistor operates as a resistor connected between the source and drain electrodes. In other words, the PMOS transistor operates as a variable resistor such that the resistance between the source and drain electrodes is selected based on the voltage level at the gate electrode.

When the scan signal SCAN is activated, the data signal DATA is applied to the gate electrode of the driving transistor TR1. The amount of charge stored in the storage capacitor is based on the data signal DATA, and thus the voltage difference between two electrodes of the storage capacitor $C_{ST}$ is changed. For example, the voltage difference between two electrodes of the storage capacitor $C_{ST}$ is changed from a first voltage to a second voltage. Here, first voltage corresponds to the voltage obtained by subtracting the initialization voltage $V_{INT}$ from the first power supply voltage ELVDD. The second voltage corresponds to the voltage obtained by subtracting the data signal DATA from the first power supply voltage ELVDD. In other words, the data signal DATA is stored in the storage capacitor $C_{ST}$.

As described above, the data applying transistor TR3 and the diode connecting transistor TR4 can be operated as resistors. Thus, when the activation level V1 of the scan signal SCAN is changed, the time required for storing the data signal DATA in the storage capacitor $C_{ST}$ is changed. For example, when the difference between the activation level V1 and the deactivation level V2 of the scan signal SCAN decreases, the currents flowing through the data applying transistor TR3 and the diode connecting transistor TR4 decrease, and thus the amount of charge stored in the storage capacitor $C_{ST}$ decreases. In other words, the amount of charge stored in the storage capacitor $C_{ST}$ can be controlled by controlling the activation level V1 of the scan signal SCAN.

The first emission control transistor TR5 connects the first power supply voltage ELVDD to the first electrode of the driving transistor TR1 in response to the emission signal EM. The first emission control transistor TR5 has a first electrode receiving the first power supply voltage ELVDD, a gate electrode receiving the emission signal EM and a second electrode connected to the first electrode of the driving transistor TR1.

The second emission control transistor TR6 connects the second electrode of the driving transistor TR1 to the emitting element OLED in response to the emission signal EM. The second emission control transistor TR6 has a first electrode connected to the second electrode of the driving transistor TR1, a gate electrode receiving the emission signal EM and a second electrode connected to the second electrode of the emitting element OLED.

When the emission signal EM is activated, the first emission control transistor TR5 connects the first power supply voltage ELVDD to the driving transistor TR1, the second emission control transistor TR6 connects the driving transistor TR1 to the OLED, and thus the OLED emits light based on the emission current IE. When the emission signal EM is deactivated (e.g., during the period t1), the first emission control transistor TR5 disconnects the first power supply voltage ELVDD from the driving transistor TR1, the second emission control transistor TR6 disconnects the driving transistor TR1 from the OLED, and thus the operation of initializing the storage capacitor and the operation of applying the data signal DATA to the storage capacitor $C_{ST}$ can be performed without affecting to the first power supply voltage ELVDD and the OLED.

In some example embodiments, the activation level V1 of the scan signal SCAN is controlled by decreasing the difference between the activation level V1 and the deactivation level V2 of the scan signal SCAN. When the difference between the activation level V1 and the deactivation level V2 of the scan signal SCAN decreases, the current, which corresponds to the data signal DATA and flows through the data applying transistor TR3, the driving transistor TR1, the diode connecting transistor TR4 and the storage capacitor $C_{ST}$, decreases. Thus, the voltage level at the gate electrode of the driving transistor TR1 decreases and the emission current IE generated by the driving transistor TR1 increases based on the controlled activation level V1 of the scan signal SCAN.

In some example embodiments, the boost capacitor $C_B$ is connected between the gate electrode of the driving transistor TR1 and the gate electrode of the data applying transistor TR3. The boost capacitor $C_B$ boosts the level (e.g., the voltage level) of the data signal DATA (e.g., the voltage level at the gate electrode of the driving transistor TR1) when the scan signal SCAN is deactivated. For example, the boost capacitor $C_B$ may be a parasitic capacitor. The activation level V1 of the scan signal SCAN can be controlled by decreasing the difference between the activation level V1 and the deactivation level V2 of the scan signal SCAN, and the level of the data signal DATA (e.g., the voltage level at the gate electrode of the driving transistor TR1) boosted by the boost capacitor $C_B$ decreases.

While the scan signal SCAN is activated (e.g., during the period t3), the data signal DATA is applied to the gate electrode of the driving transistor TR1 through the data applying transistor TR3, the driving transistor TR1 and the diode connecting transistor TR4. The amount of charge stored in the boost capacitor $C_B$ corresponds to the voltage difference between the gate electrode of the driving transistor TR1 and the gate electrode of the data applying transistor TR3.

As illustrated in FIG. 2, the first electrode of the boost capacitor $C_B$ is connected to the scan signal SCAN and a second electrode of the boost capacitor $C_B$ is connected to the gate electrode of the driving transistor TR1. When the scan signal SCAN is transitioned from the activation level V1 to the deactivation level V2 , the voltage level at the first electrode of the boost capacitor $C_B$ is changed, and then the voltage level at the second electrode of the boost capacitor $C_B$ is changed based on the amount of charge stored in the boost capacitor $C_B$. Thus, when the difference between the activation level V1 and the deactivation level V2 of the scan signal SCAN decreases, the level of the data signal DATA (e.g., the voltage level at the gate electrode of the driving transistor TR1) boosted by the boost capacitor $C_B$ decreases.

In a first example, the activation level V1 of the scan signal SCAN is about −5V, the deactivation level V2 of the scan signal SCAN is about 0V, and the voltage level at the second electrode of the boost capacitor $C_B$ is about 1V while the scan signal SCAN is activated. In the first example, when the scan signal SCAN is deactivated, the voltage level at the first electrode of the boost capacitor $C_B$ is changed from about −5V to about 0V and the voltage level at the second electrode of the boost capacitor $C_B$ is changed from about 1V to about 6V. In a second example, the controlled activation level of the scan signal SCAN is about −3V, the deactivation level V2 of the scan signal SCAN is about 0V, and the voltage level at the second electrode of the boost capacitor $C_B$ is about 1V while the scan signal SCAN is activated. In the second example, when the scan signal SCAN is deactivated, the voltage level at the first electrode of the boost capacitor $C_B$ is changed from about −3V to about 0V and the voltage level at the second electrode of the boost capacitor $C_B$ is changed from about 1V to about 4V.

When the level of the data signal DATA (e.g., the voltage level at the gate electrode of the driving transistor TR1) boosted by the boost capacitor $C_B$ decreases, the emission current IE generated by the driving transistor TR1 increases. As described above, when the activation level V1 of the scan signal SCAN is changed from about −5V to about −3V, the voltage level at the second electrode of the boost capacitor $C_B$ (e.g., the voltage level at the gate electrode of the driving transistor TR1) is changed from about 6V to about 4V, and thus the emission current IE generated by the driving transistor TR1 increases.

As described above, when the activation level V1 of the scan signal SCAN is controlled, the amount of charge stored in the storage capacitor $C_{ST}$ changes and the voltage level at the gate electrode of the driving transistor TR1 changes. In addition, when the activation level V1 of the scan signal SCAN is controlled, the voltage level at the gate electrode of the driving transistor TR1 also changes due to the boost capacitor $C_B$. Even if the same data signal DATA is applied to the gate electrode of the driving transistor TR1, the voltage level at the gate electrode of the driving transistor TR1 can be changed by controlling the activation level V1 of the scan signal SCAN. Accordingly, the emission current IE generated by the driving transistor TR1 can be changed by controlling the activation level V1 of the scan signal SCAN and the OLED can emit light with a luminance higher than the maximum luminance determined by the gamma settings by controlling the activation level V1 of the scan signal SCAN.

Figure 4:
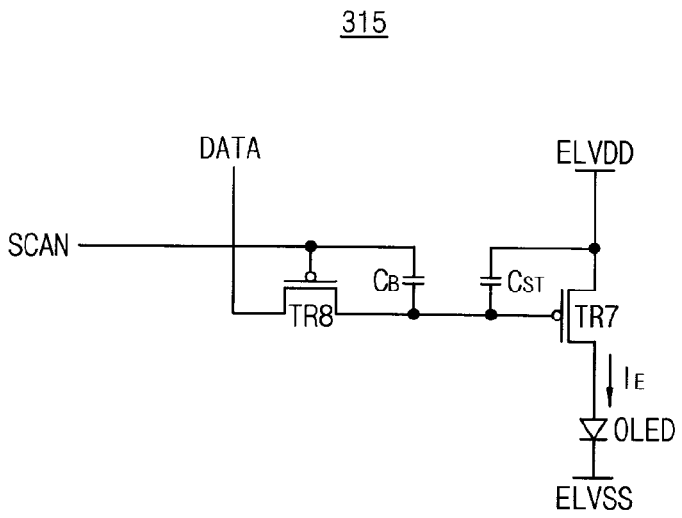
FIG. 4 is a circuit diagram illustrating another example of the pixel included in the display device of FIG. 1.

FIG. 4 is a circuit diagram illustrating another example of the pixel included in the display device of FIG. 1.

Referring to FIG. 4, the pixel includes a storage capacitor $C_{ST}$, a data applying transistor or switching transistor TR8, a driving transistor TR7 and an emitting element OLED. The pixel 315 further includes a boost capacitor $C_B$.

The storage capacitor $C_{ST}$ is charged (e.g., stores electric charge) based on the data signal DATA applied by the data applying transistor TR8. The storage capacitor $C_{ST}$ is connected between the first power supply voltage ELVDD and a gate electrode of the driving transistor TR7. The voltage level at the gate electrode of the driving transistor TR7 is maintained during a predetermined period based on the charge stored in the storage capacitor $C_{ST}$.

The data applying transistor TR8 has a first electrode receiving the data signal DATA, a gate electrode receiving the scan signal SCAN and a second electrode connected to the gate electrode of the driving transistor TR7. The data applying transistor TR8 controls the amount of charge stored in the storage capacitor $C_{ST}$ based on the scan signal SCAN.

The driving transistor TR7 has a first electrode connected to the first power supply voltage ELVDD, the gate electrode connected to the second electrode of the data applying transistor TR8 and a second electrode connected to a first electrode of the emitting element OLED. The driving transistor TR7 generates an emission current IE based on the data signal DATA applied to the gate electrode of the driving transistor TR7.

The emitting element may be an organic light-emitting diode (OLED) that emits light based on the emission current IE. The OLED emits light with a luminance corresponding to the emission current IE. The OLED has the first electrode connected to the second electrode of the driving transistor TR7 and a second electrode connected to the second power supply voltage ELVSS.

The boost capacitor $C_B$ has a first electrode connected to the gate electrode of the driving transistor TR7 and a second electrode receiving the scan signal SCAN. The boost capacitor $C_B$ boosts the level (e.g., the voltage level) of the data signal DATA (e.g., the voltage level at the gate electrode of the driving transistor TR7) when the scan signal SCAN is deactivated.

As described above with reference to FIGS. 2 and 3, when the activation level V1 of the scan signal SCAN is controlled, the amount of charge stored in the storage capacitor $C_{ST}$ changes and the voltage level at the gate electrode of the driving transistor TR7 changes. In addition, when the activation level V1 of the scan signal SCAN is controlled, the voltage level at the gate electrode of the driving transistor TR7 changes due to the boost capacitor $C_B$. Even if the same data signal DATA is applied to the gate electrode of the driving transistor TR7, the voltage level at the gate electrode of the driving transistor TR7 can be changed by controlling the activation level V1 of the scan signal SCAN. Accordingly, the emission current IE generated by the driving transistor TR7 can be changed by controlling the activation level V1 of the scan signal SCAN and the OLED can emit light with a luminance higher than the maximum luminance determined by the gamma settings of the display by controlling the activation level V1 of the scan signal SCAN.

Figure 5:
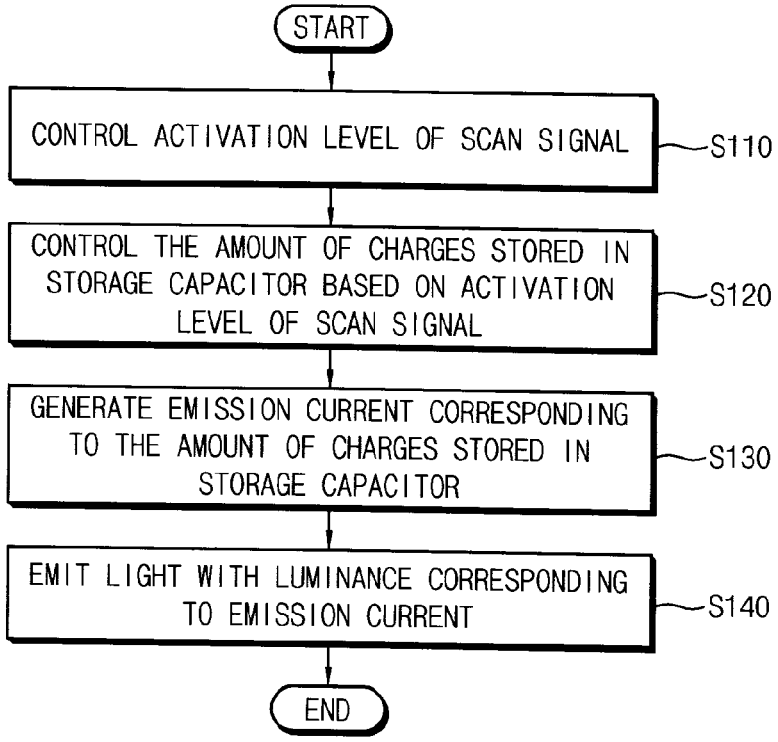
FIG. 5 is a flow chart illustrating a method of driving a display device according to example embodiments.

FIG. 5 is a flow chart illustrating a method of driving a display device according to example embodiments.

Referring to FIG. 5, in a method of driving a display device according to example embodiments, the display device includes a pixel that includes a storage capacitor, a data applying transistor, a driving transistor and an emitting element. The activation level of a scan signal applied to the data applying transistor is controlled (step S110). The amount of charge stored in the storage capacitor is controlled based on the activation level of the scan signal (step S120). An emission current corresponding to the amount of charge stored in the storage capacitor is generated by the driving transistor (step 130). Light with a luminance corresponding to the emission current is emitted by the emitting element (step S140). In some example embodiments, a data signal is applied to a gate electrode of the driving transistor and the level of the data signal (e.g., the voltage level at the gate electrode of the driving transistor) is boosted when the scan signal is deactivated.

In step S110, the activation level of the scan signal can be controlled when the operating mode of the display device is changed. For example, the activation level of the scan signal can be controlled when the operating mode of the display device is changed from a normal mode to a photo therapy mode, and thus the emission current increases based on the controlled activation level of the scan signal. As an another example, the activation level of the scan signal can be controlled when the operating mode of the display device is changed from the photo therapy mode to the normal mode, and thus the emission current is restored (e.g., decreases) based on the controlled activation level of the scan signal. In the photo therapy mode, the display device can emit light with a single color. In addition, in the photo therapy mode, it is required to emit light from the display device with relatively high luminance. The activation level of the scan signal can be controlled when the display device operates in the photo therapy mode, and thus, during the photo therapy mode, the display device can emit light with a luminance which is higher than the maximum luminance determined by the gamma settings of the display.

In step S120, the amount of charge stored in the storage capacitor is controlled when the scan signal is activated based on the activation level. When the amount of charge stored in the storage capacitor is changed, the voltage difference between two electrodes of the storage capacitor are changed and the voltage level at the gate electrode of the driving transistor is changed when the storage capacitor is connected to the gate electrode of the driving transistor. Thus, the emission current generated by the driving transistor is also changed.

In some example embodiments, the activation level of the scan signal can be controlled by decreasing the difference between the activation level and the deactivation level of the scan signal, and thus the emission current increases based on the controlled activation level of the scan signal. In other example embodiments, the activation level of the scan signal can be controlled by increasing the difference between the activation level and the deactivation level of the scan signal, and thus the emission current decreases based on the controlled activation level of the scan signal.

Typically, a transistor, which has a source electrode, a gate electrode and a drain electrode and operates in a linear region, can operate as a variable resistor such that the resistance between the source and drain electrodes of the transistor is selected based on the voltage level at the gate electrode of the transistor. For example, in a PMOS transistor operating in a linear region, the resistance between the source electrode and the drain electrode decreases as the voltage level at the gate electrode is decreased to less than the voltage level at the source electrode. Accordingly, if the voltage level at the gate electrode is sufficiently low, the resistance between the source and drain electrodes is substantially zero, and thus the PMOS transistor operates as a switch that connects the source electrode to the drain electrode. In addition, in the PMOS transistor operating in the linear region, the resistance between the source and drain electrodes increases as the voltage level at the gate electrode approaches the voltage level at the source electrode. Accordingly, if the voltage level at the gate electrode is sufficiently close to the voltage level at the source electrode, the resistance between the source and drain electrodes is substantially infinite, and thus the PMOS transistor can operate as a switch that disconnects the source electrode from the drain electrode. However, when the voltage level at the gate electrode is not sufficiently low and the voltage level at the gate electrode is not sufficiently close to the voltage level at the source electrode, the PMOS transistor operates as a resistor connected between the source and drain electrodes. In other words, the PMOS transistor may operate as a variable resistor such that the resistance between the source and drain electrodes is selected based on the voltage level at the gate electrode.

As described above, the data applying transistor, which has a gate electrode receiving the scan signal and controls the amount of charge stored in the storage capacitor when the scan signal is activated, can operate as a resistor. Thus, when the activation level of the scan signal is changed, the time required for storing the data signal in the storage capacitor can be changed. For example, when the difference between the activation level and the deactivation level of the scan signal decreases, the current flowing through the data applying transistor decreases, and thus the amount of charge stored in the storage capacitor decreases. In other words, the amount of charges stored in the storage capacitor can be controlled by controlling the activation level of the scan signal.

In the step S130, the driving transistor generates the emission current based on the data signal applied to the gate electrode of the driving transistor. For example, the driving transistor can operate in a saturation region. The driving transistor generates the emission current in the saturation region based on a voltage difference between the gate electrode and a source electrode.

In the step S140, the emitting element may be an OLED that emits light based on the emission current. The OLED emits light with a luminance corresponding to the emission current.

In some example embodiments, the pixel further includes a boost capacitor. When the scan signal is deactivated, the level of the data signal (e.g., the voltage level at the gate electrode of the driving transistor) is boosted by the boost capacitor. The activation level of the scan signal is controlled by decreasing the difference between the activation level and the deactivation level of the scan signal and the level of the data signal (e.g., the voltage level at the gate electrode of the driving transistor) boosted by the boost capacitor decreases.

For example, a first electrode of the boost capacitor is connected to the scan signal and a second electrode of the boost capacitor is connected to the gate electrode of the driving transistor. When the scan signal is transitioned from the activation level to the deactivation level, the voltage level at the first electrode of the boost capacitor is changed and then the voltage level at the second electrode of the boost capacitor is changed based on the amount of charge stored in the boost capacitor. Thus, when the difference between the activation level and the deactivation level of the scan signal decreases, the level of the data signal (e.g., the voltage level at the gate electrode of the driving transistor) boosted by the boost capacitor decreases.

When the level of the data signal (e.g., the voltage level at the gate electrode of the driving transistor) boosted by the boost capacitor decreases, the emission current generated by the driving transistor may increase.

As described above, when the activation level of the scan signal is controlled, the amount of charge stored in the storage capacitor can be changed and the voltage level at the gate electrode of the driving transistor can be changed. In addition, when the activation level of the scan signal is controlled, the voltage level at the gate electrode of the driving transistor can also be changed by the boost capacitor. Even if the same data signal is applied to the gate electrode of the driving transistor, the voltage level at the gate electrode of the driving transistor can be changed by controlling the activation level of the scan signal. Accordingly, the emission current generated by the driving transistor can be changed by controlling the activation level of the scan signal and the OLED can emit light with a luminance higher than the maximum luminance determined by the gamma settings of the display by controlling the activation level of the scan signal.

Although the example embodiments are described based on a pixel including at least one PMOS transistor, the example embodiments are not limited thereto.

The described technology can be applied to an electronic device having a display device. For example, the described technology be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the invention as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device, comprising:

a display panel including a plurality of pixels;

a scan driver configured to apply a scan signal to the pixels, wherein the scan signal has an activation level and a deactivation level; and a data driver configured to apply a data signal to the pixels, wherein each of the pixels comprises:

a storage capacitor configured to store charge based on the data signal;

a switching transistor configured to apply the data signal to the storage capacitor in response to the scan signal;

a driving transistor configured to generate an emission current corresponding to the stored charge; and an emitting element configured to emit light based on the emission current, wherein the scan driver is configured to selectively control the activation level of the scan signal, wherein the scan driver is further configured to select the activation level of the scan signal so as to control the amount of charge stored in the storage capacitor, and wherein the driving transistor is configured to control the emission current based on the amount of charge stored in the storage capacitor.

2. The display device of claim 1, wherein the scan driver is further configured to decrease the difference between the activation level and the deactivation level of the scan signal and wherein the driving transistor is further configured to increase the emission current based on the decrease in the difference between the activation and deactivation levels of the scan signal.

3. The display device of claim 1, wherein the scan driver is further configured to select the activation level of the scan signal when an operating mode of the display device is changed.

4. The display device of claim 3, wherein the scan driver is further configured to select the activation level of the scan signal when the operating mode of the display device is changed from a normal mode to a photo therapy mode and wherein the emission current is configured to increase based on the selected activation level of the scan signal.

5. The display device of claim 1, wherein the emitting element is an organic light-emitting diode (OLEO).

6. The display device of claim 5, wherein each of the pixels further includes:

an initialization transistor configured to apply an initialization voltage to the storage capacitor in response to an initialization signal;

a first emission control transistor configured to connect a first power supply voltage to a first electrode of the driving transistor in response to an emission signal;

a diode connecting transistor configured to connect a gate electrode of the driving transistor to a second electrode of the driving transistor in response to the scan signal; and a second emission control transistor configured to connect the second electrode of the driving transistor to the OLED in response to the emission signal.

7. The display device of claim 6, wherein the initialization transistor is further configured to apply the initialization voltage to the storage capacitor so as to initialize the storage capacitor.

8. The display device of claim 7, wherein the storage capacitor is configured to receive the data signal via the switching transistor, the driving transistor and the diode connecting transistor when the scan signal is activated after the storage capacitor is initialized.

9. The display device of claim 8, wherein the storage capacitor is configured to receive the data signal as a data current via the switching transistor, the driving transistor and the diode connecting transistor, wherein the scan driver is further configured to selectively decrease the difference between the activation level and the deactivation level of the scan signal and wherein the data current is configured to decrease based on the decrease in the difference between the activation and deactivation levels of the scan signal.

10. The display device of claim 1, wherein each of the pixels further include: a boost capacitor connected between a gate electrode of the driving transistor and a gate electrode of the switching transistor, wherein the boost transistor is configured to boost a level of the data signal applied to the storage capacitor when the scan signal is deactivated.

11. The display device of claim 10, wherein the scan driver is further configured to selectively decrease the difference between the activation level and the deactivation level of the scan signal and wherein the level of the data signal boosted by the boost capacitor is configured to decrease based on the decrease in the difference between the activation and deactivation levels of the scan signal.

12. A display device, comprising:

a display panel including a plurality of pixels;

a scan driver configured to apply a scan signal to the pixels, wherein the scan signal has an activation level and a deactivation level; and a data driver configured to apply a data signal to the pixels, wherein each of the pixels comprises:

a storage capacitor configured to store charge based on the data signal;

a switching transistor configured to apply the data signal to the storage capacitor in response to the scan signal;

a driving transistor configured to generate an emission current corresponding to the stored charge; and an emitting element configured to emit light based on the emission current, wherein the scan driver is configured to selectively control the activation level of the scan signal to control a difference between the activation level and the deactivation level of the scan signal when an operating mode of the display device is changed, wherein the scan driver is further configured to select the activation level of the scan signal and wherein the driving transistor is configured to control the emission current based on the selected activation level of the scan signal.

13. The display device of claim 12, wherein the scan driver is further configured to decrease the difference between the activation level and the deactivation level of the scan signal and wherein the driving transistor is further configured to increase the emission current based on the decrease in the difference between the activation and deactivation levels of the scan signal.

14. The display device of claim 12, wherein the scan driver is further configured to selectively control the activation level of the scan signal when the operating mode of the display device is changed from a normal mode to a photo therapy mode and when the operating mode of the display device is changed from the photo therapy mode to the normal mode.

15. The display device of claim 14, wherein when the operating mode of the display device is changed from the normal mode to the photo therapy mode, the driving transistor is further configured to increase the emission current based on the controlled activation level of the scan signal.

16. A method of driving a display device including a plurality of pixels, each of the pixels including a storage capacitor, a switching transistor, a driving transistor and an emitting element, the method comprising:

controlling an activation level of a scan signal applied to the switching transistor, wherein the scan signal has the activation level and a deactivation level, and wherein the switching transistor operates as a variable resistor such that the resistance between the source and drain electrodes is based on the level of scan signal;

controlling an amount of charge stored in the storage capacitor based on the activation level of the scan signal;

generating, by the driving transistor, an emission current corresponding to the amount of charge stored in the storage capacitor; and emitting, by the emitting element, light with a luminance corresponding to the emission current.

17. The method of claim 16, wherein the scan signal has the activation level and a deactivation level, wherein the activation level of the scan signal is controlled by decreasing the difference between the activation level and the deactivation level of the scan signal and wherein driving transistor increases the emission current based on the decrease in the difference between the activation and deactivation levels of the scan signal.

18. The method of claim 16, wherein the activation level of the scan signal is controlled when an operating mode of the display device is changed.

19. The method of claim 18, wherein the activation level of the scan signal is controlled when the operating mode of the display device is changed from a normal mode to a photo therapy mode and wherein the driving transistor increases the emission current based on the controlled activation level of the scan signal.

20. The method of claim 19, wherein the activation level of the scan signal is controlled when the operating mode of the display device is changed from the photo therapy mode to the normal mode and wherein the driving transistor decreases the emission current based on the controlled activation level of the scan signal.

* * * * *